US005675978A

United States Patent [19]

Hamm, Jr. et al.

[11] Patent Number: 5,675,978

[45] Date of Patent: Oct. 14, 1997

[54] OIL MANAGEMENT APPARATUS FOR A REFRIGERATION CHILLER

[75] Inventors: Frederic B. Hamm, Jr., Onalaska; David H. Eber, La Crosse, both of Wis.

[73] Assignee: American Standard Inc., Piscataway, N.J.

[21] Appl. No.: 756,629

[22] Filed: Nov. 26, 1996

[51] Int. Cl.[6] ..... F25B 43/02

[52] U.S. Cl. ..... 62/84; 62/468; 137/625.19

[58] Field of Search ..... 62/84, 85, 468, 62/469, 470, 474, 475; 137/625.19, 595

[56] References Cited

U.S. PATENT DOCUMENTS 5,165,248 11/1992 Sishtla ..... 62/468
5,318,411 6/1994 Heinrichs et al. ..... 417/313
5,396,784 3/1995 Huenniger ..... 62/84

*Primary Examiner*—John M. Sollecito
*Attorney, Agent, or Firm*—William J. Beres; William O'Driscoll; Peter D. Ferguson

[57] ABSTRACT

Oil management apparatus for a refrigeration chiller includes a housing mounted to the head wall of an oil supply tank. The housing defines a series of ports and internal flow passages in communication with a valve cavity. A valve spindle disposed in the cavity is configured and positionable such that a plurality of oil flow passages within the chiller are capable of being setup in order to accommodate various chiller lubrication needs including those as they relate to both chiller operation and maintenance. The combination of an integral housing and single valve eliminates a large number of individual valves and the need to connect those valves and various chiller lubrication components, such as an oil filter and oil pressure regulator, with individual sections of difficult to fabricate piping. As a result, the likelihood of error in the setup of a chiller lubrication system is significantly reduced.

24 Claims, 7 Drawing Sheets

FIG. 9
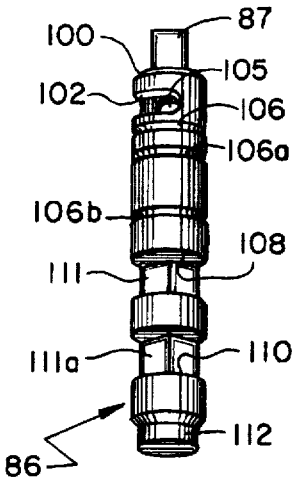
FIG. 10
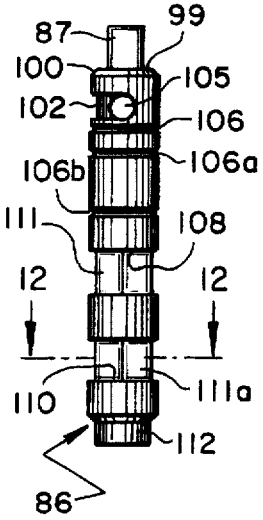
FIG. 11
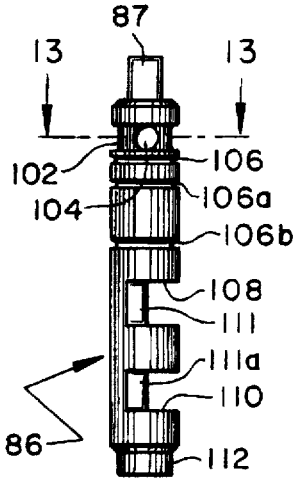
FIG. 12
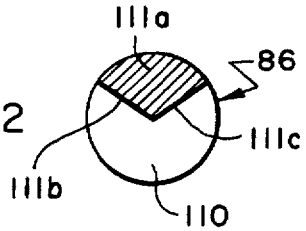
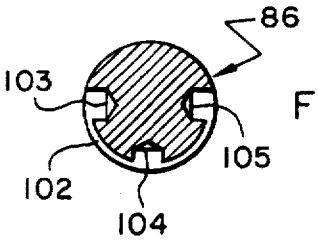
FIG. 13
FIG. 15
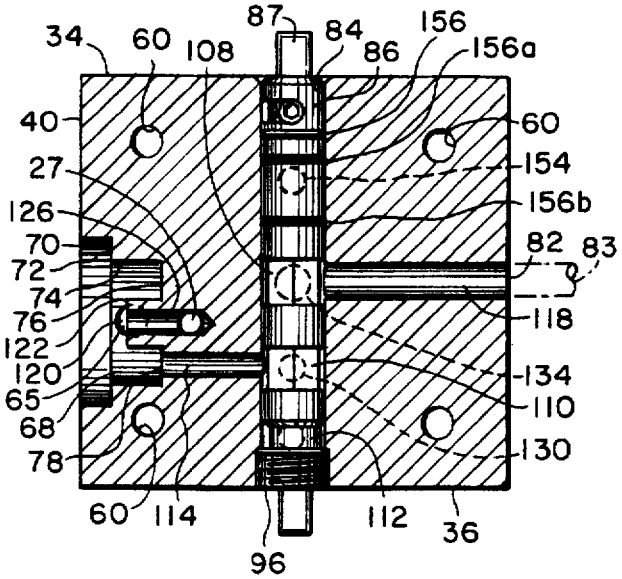
FIG. 17
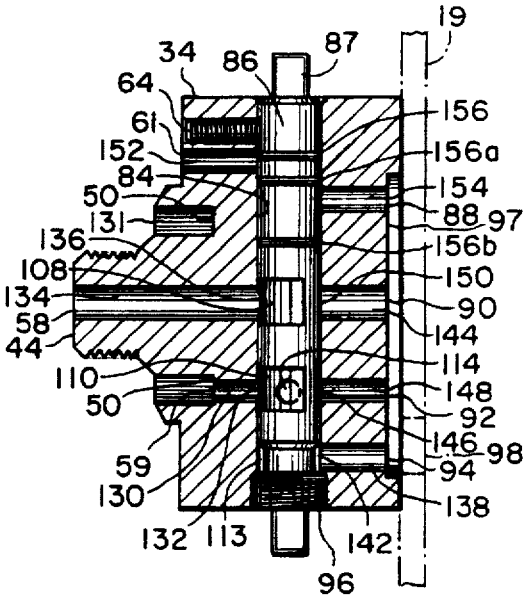

OIL MANAGEMENT APPARATUS FOR A REFRIGERATION CHILLER

BACKGROUND OF THE INVENTION

The present invention relates to liquid chillers. More particularly, the present invention relates to an oil management system for a refrigeration chiller.

Chiller systems have various parts and components that require lubrication. Lubrication has previously been provided to such parts by means of an intricate closed loop oil delivery system.

It is important that such systems maintain oil pressure at a specific predetermined level when a chiller is in operation. While exceedingly high oil pressures are undesirable, lack of sufficient oil pressure can result in inadequate lubricant delivery to the chiller surfaces and components that require lubrication. An oil pressure regulator is employed in such systems in that regard.

It is also necessary to insure that the oil delivered to the surfaces and components which require lubrication in a chiller is substantially free from contaminants which might harm such components or surfaces. An oil filtering arrangement is employed in such systems in that regard.

For example and turning to FIGS. 23 and 24, existing chiller oil delivery system 200 includes an oil tank 202 in which an oil pump 203 (shown in phantom) is disposed. Pump 203 is submerged in the oil in tank 202 the level of oil in which is indicated at 205.

Lubricating oil is pumped out of tank 202 through oil line 203*a* to oil pressure regulator 204. The oil then passes through another oil line to an oil filter 206. Filtered oil is then distributed from the filter to the lubrication points on the chiller through still other oil lines. Additional oil lines exist for the purpose of bypassing the oil filter during filter replacement and for returning oil from the pressure regulator to the oil supply tank under certain operating conditions.

Exemplary ones of the various oil lines associated with lubrication system 200 are indicated by reference numeral 208 in FIGS. 23 and 24 and each is individually fabricated and fit-up. Even slight chiller component dimensional variation or variations in component alignment can cause problems in the fit-up of the oil lines 208 which carry oil to or from such components. Similarly, because the oil lines are individually fabricated, dimensional variation in them can cause problems in their connection and fit-up to the components they serve. Further, because the oil lines are essentially "custom" parts, their fabrication and fit-up add significant expense to a chiller and the process of its manufacture and assembly.

Also, the use of several valves has typically been required in current and previous systems in order to isolate the oil filter receptacle from the interior of the chiller to allow for the filter to be changed. Additional valves are used to drain oil from the system for chiller maintenance and repair. An intricate assembly of pipe sections and valves has likewise been required in support of these valves and chiller lubrication needs and options. Such assemblies have typically been created by supporting numerous short lengths and geometries of pipe in a jig and then attaching them such as by brazing. Leaks and other assembly problems can occur and are difficult to detect and correct, oftentimes until after the assembly is complete and/or is installed on a chiller. Time consuming and expensive re-work is sometimes necessary to fix such problems and an unacceptable amount of scrap material can result.

Further, the complexity of existing and previous lubrication assemblies and systems, in terms of the number of valves they employ and the piping flow passages they are capable of creating, can lead to problems in the field once a chiller is installed. For example, in order to drain a chiller oil system or isolate an oil filter for replacement in current systems, multiple valves must be properly positioned. In such systems, an inexperienced operator might arrange such valves to inconsistent or incorrect positions and/or fail to properly reposition them for chiller operation. Decrease in oil pressure, blockage of oil flow to the various lubrication points on the chiller and/or damage to or failure of the chiller system can result.

Still further, chillers are typically fully assembled by the manufacturer then shipped to a customer for installation. During transport and installation, a chiller is lifted for transport and installation by chains, slings or other lifting gear. During installation, the exposed and relatively fragile lubrication lines are subject to crimping, denting, bending and/or breakage due to contact with lifting gear or nearby objects. These lines are also vulnerable to bending or breaking when used as a handhold or step after the chiller is installed.

Additionally, each line which is soldered or brazed in the oil delivery system is a potential source of leakage or contamination of the oil within the system. Soldering or brazing remnants are potentially harmful to the parts of the chiller system being lubricated and solder/braze joint locations are subject to leakage and/or failure that can go undetected and/or not initially fail until after chiller system installation and startup. Chiller downtime and/or damage can result.

The need remains for oil management apparatus in a refrigeration chiller which minimizes the necessity to employ external lines connecting the various components of a chiller lubrication system, which reduces the complexity of associated valving, which is less susceptible to damage and which is more repeatable and economical of manufacture.

SUMMARY OF THE INVENTION

It is an object of the present invention to provide integral oil management apparatus for a refrigeration chiller which has an internal valve structure and integral receptacles for receiving oil filter and pressure regulator components.

It is another object of the present invention to eliminate multiple individual oil lines connecting multiple discrete components and lubrication points in a liquid chiller.

It is still another object of the invention to provide apparatus which employs a single valve element to coordinate and establish proper oil flow in a chiller system under several different chiller lubrication-related maintenance and operational circumstances.

These and other objects are achieved, in whole or in part, by a refrigeration chiller having integral oil management apparatus which includes a single valve for managing the flow of oil between an oil tank, an oil pump, various lubrication system-related components, including an oil filter and an oil pressure regulator, and various chiller lubrication points.

The assembly includes a housing which has integral oil filter and oil pressure regulator receptacles and which defines a valve chamber which is in fluid communication with the pressure regulator, the oil filter and the chiller lubrication points through a series of ports defined internal of the housing. Communication between internal valve ports defined by the housing is selectively controlled by the positioning of a single valve spool. As a result of the internal porting arrangement, numerous valves and interconnecting oil lines are eliminated and the establishment of proper lubricant flow passages for differing chiller operational, maintenance and repair circumstances is made significantly easier and more reliable.

BRIEF DESCRIPTION OF THE DRAWINGS

FIG. 9 is a perspective view of the valve spindle used in the housing of FIG. 3.

FIG. 10 is a right side elevation of the valve spindle of FIG. 9.

FIG. 11 is a front elevation of the valve spindle of FIG. 9.

FIG. 12 is a cross-section of the valve spindle taken along line 12—12 of FIG. 10.

FIG. 13 is a cross-section of the valve spindle taken along line 13—13 of FIG. 11.

FIG. 15 is a cross-section of the housing of FIG. 3 taken along line 15—15 in FIG. 4.

FIG. 17 is a cross-section of the housing of FIG. 3 taken along lines 16—16 in FIG. 3. A portion of the oil tank wall to which the housing is attached is also shown.

DETAILED DESCRIPTION OF THE INVENTION

While the present invention will be described in terms of a preferred embodiment, it will be understood that the invention is not limited to that embodiment but includes all alternatives, modifications, and equivalents as may be included within the spirit and scope of the appended claims.

Figure 2:
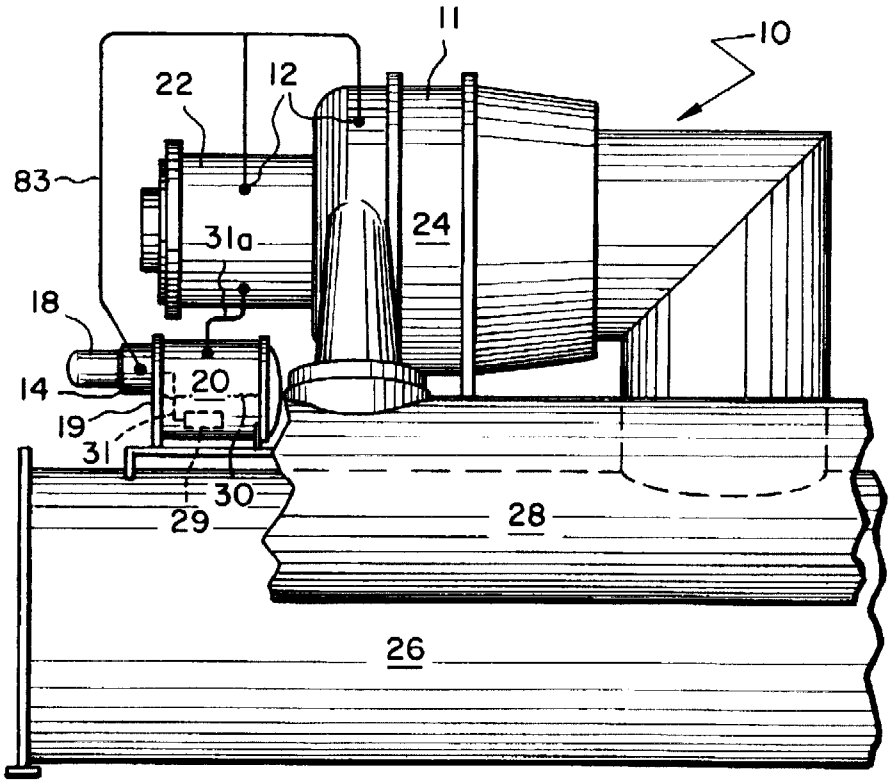
FIG. 2 is a partial side elevation of the chiller of FIG. 1.
Figure 1:
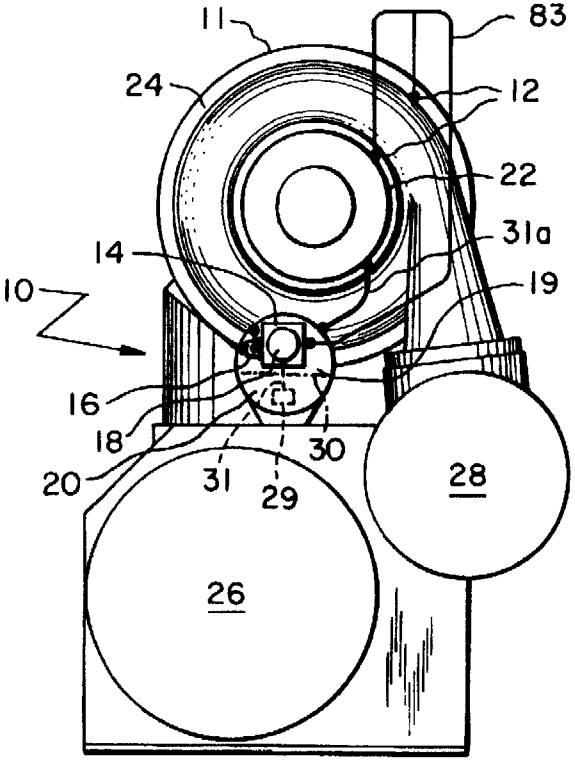
FIG. 1 is a front elevation of a chiller including the chiller oil management system of the present invention.

FIGS. 1 and 2 show a liquid chiller 10 which employs a compressor 11. In operation, compressor 11 requires lubrication at multiple locations, such as representative lubrication points 12. Examples of such lubrication points are the various bearings and, in some chillers, gears in the compressor drive train.

The chiller oil management apparatus of the present invention includes a unitary housing 14, a pressure regulator 16, and an oil filter 18. Pressure regulator 16 and oil filter 18 are installed directly on housing 14 which itself is directly mounted on head wall 19 of oil supply tank 20. Compressor 11 has a motor portion 22 and a centrifugal compression portion 24. Other components of chiller 10 include an evaporator 26 and a condenser 28.

A pump 29 is submerged below the surface level 30 of oil in tank 20. Pump 29 pumps oil from tank 20 to housing 14 through piping 31 as will further be described. Housing 14, which is mounted exterior of supply tank 20 is mounted at an elevation on head wall 19 which is higher than the surface level 30 of oil within the supply tank. Oil is returned to tank 20 after its delivery to and use at chiller lubrication points 12 via a drain line 31*a*.

Referring additionally now to FIGS. 3–8, housing 14 is a cast or machined block of metal, such as iron or steel. It will be appreciated that various passages and features of housing 14 may be at least rough formed during the casting process.

Housing 14 has a front face 32, a top face 34, a bottom face 36, a back face 38 and first and second side faces 40 and 42. The features and elements of each of these faces will first be described in isolation. Their function and interaction will subsequently be described.

Figure 3:
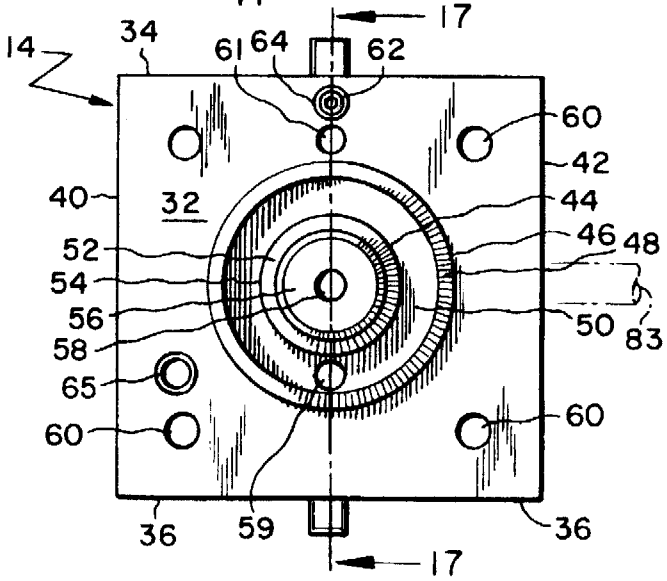
FIG. 3 is an enlarged, isolated front elevation of the housing of the oil management arrangement of the present invention with the oil filter and pressure regulator removed.

Referring first to FIG. 3 and front face 32, an oil filter receptacle 44 is integrally formed in it and is similar to the oil filter receptacle of a conventional automobile engine. Receptacle 44 has a cylindrical base ring 46 which includes a sealing surface 48 and defines an annular groove 50. A collar 52 is concentric with surface 48 and connects the annular base ring 46 to a threaded nose 54. Threaded nose 54 has an annular sealing surface 56 which is concentric with seal surface 48. A filter output port 58 is defined in annular sealing surface 56 while a filter input port 59, eccentric with annular ring 46, and is defined in annular surface 50.

Moving away from oil filter receptacle 44 but still on front face 32, a lubrication port 61 is centrally located above oil filter receptacle 44 and a passage 62 extends into housing 14 for receiving a set screw or locking pin 64 the purpose of which will further be described. An oil sampling port 65 is likewise defined in front face 32 of the housing and mounting bores 60 are configured to receive fasteners for securing housing 14 to the head wall 19 of oil tank 20. Bores 60 are located at the corners of the front face 32, pass through the housing 14, and open into its back face 38.

Figure 4:
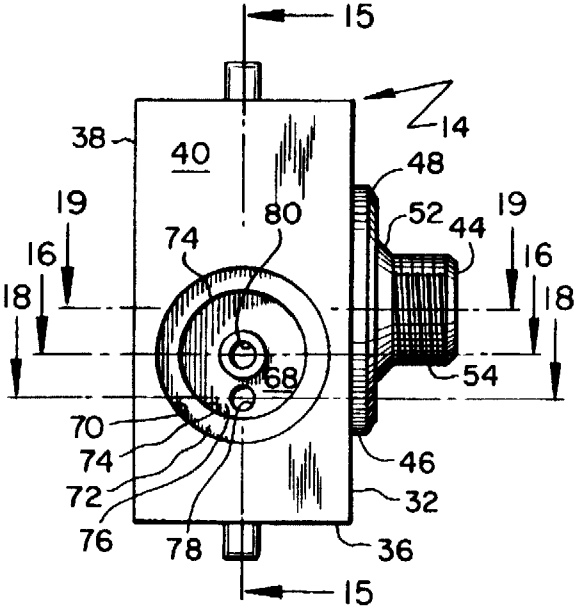
FIG. 4 is a left side elevation of the housing shown in FIG. 3.

Referring now to FIGS. 1 and 4 and first side face 40 of housing 14, a stepped oil regulator recess 68, in which pressure regulator 16 is accommodated, is defined therein. Regulator recess 68 is defined by outer cylindrical wall 70, an annular lip surface 72, an interior cylindrical wall 74, and an annular surface 76 of housing 14. A pressure regulator overflow port 80 is centrally located within the recess 68. The structure and operation of the pressure regulator which recess 68 is configured to accommodate is more fully discussed below with respect to FIG. 14.

Figure 5:
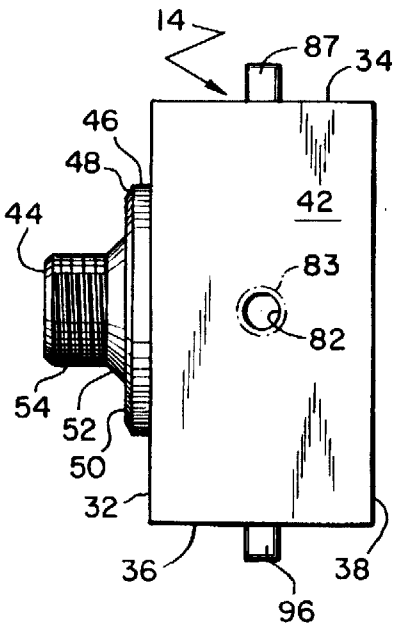
FIG. 5 is a right side elevation of the housing shown in FIG. 3.

Referring now to FIGS. 1 and 5 and second side face 42 of housing 14, an oil feed port 82 is formed therein. Port 82 is connected to external line 83 through which oil is supplied to the lubrication points 12 in the chiller system.

Figure 6:
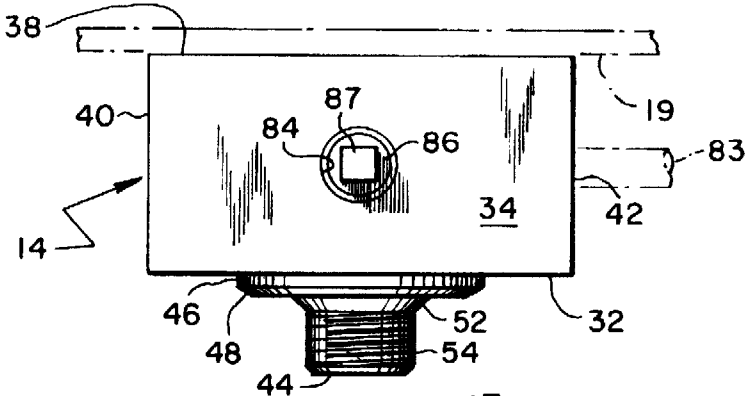
FIG. 6 is a top view of the housing shown in FIG. 3.
Figure 8:
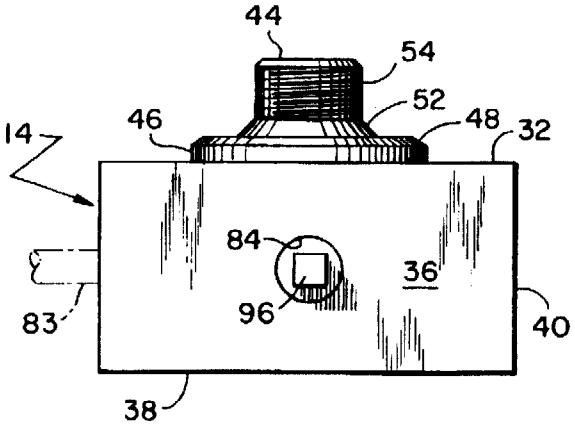
FIG. 8 is a bottom view of the housing of FIG. 3.

Referring now to FIGS. 6 and 8 and to top face 34 and bottom face 36 respectively, a generally cylindrical valve cavity 84 is defined by housing 14. Cavity 84 has a longitudinal axis that is generally perpendicular to top and bottom faces 34 and 36 and extends through housing 14 from top face 34 to bottom face 36. A valve spindle 86 is rotatably disposed within cavity 84 and has a head 87. In operation, head 87 can be gripped and rotated to one of three positions as will subsequently be discussed. A plug 96 is disposed in the lower end of the cavity 84 and has threads which engage compatible threads defined therein to seal the lower end of the valve cavity and to retain valve spindle 86 in place in chamber 84.

Figure 7:
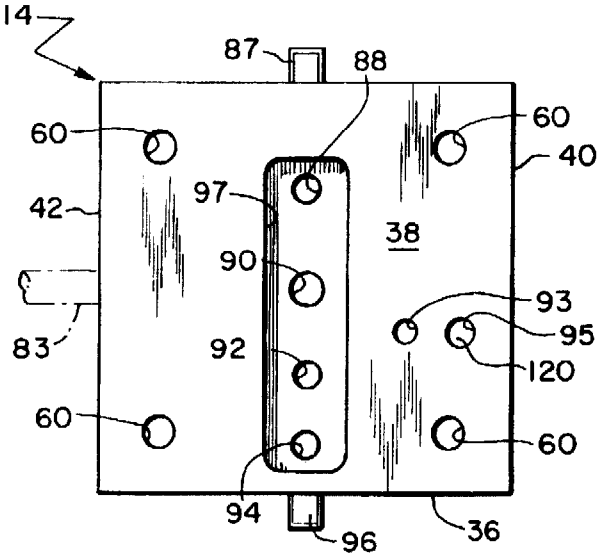
FIG. 7 is a rear view of the housing of FIG. 3.

Referring now to FIG. 7 and to back face 38, first drain port 88, second drain port 90, third drain port 92, oil pressure regulator relief port 93, oil seepage port 94, and system oil input port 95 are formed therein. Ports 88, 90, 92, 93, 94, and 95 are all in fluid communication with the interior of oil supply tank 20 through headwall 19 of oil tank 20. Ports 88, 90, 92 and 94, however, all communicate first into a recess 97 defined in back face 38.

Since ports 88, 90, 92 and 94 are all drain or seepage ports, the purpose of which is to permit oil to drain or seep back from housing 14 to oil tank 20, their communication first into recess 97 in back face 38 of housing 14 is advantageous. In that regard, rather than each of such ports communicating through separate holes in face 19 of tank 20 with which they would have to align, the ports open into recess 97 and are placed in flow communication with the interior of tank 20 through a single aperture 98 (shown in FIG. 16) in tank wall 19, the alignment of which with recess 97 is not difficult or critical. Further, by the definition of recess 97 in back face 38 of housing 14, better sealing around the periphery of housing 14 where it abuts tank wall 19 is capable of being accomplished.

Referring now to FIGS. 9, 10, 11, 12 and 13, the details of valve spindle 86 are illustrated. Spindle 86 is generally cylindrical and has various machined portions which form a series of grooves, recesses and notches. Valve spindle 86 has a top surface 99 away from which a chamfered edge 100 depends. A set screw groove 102 is positioned below surface 99. Groove 102 includes circumferentially spaced recesses 103, 104 and 105 which are best illustrated in FIG. 13. In operation, the end of a set screw or locking pin 64 (best illustrated in FIG. 3) engages one of recesses 103, 104 or 105 to hold valve spindle 86 in one of three positions within valve chamber 84 as will further be described. A series of O-ring grooves 106, 106*a*, and 106*b* are located below the groove 102.

Valve notches 108 and 110 are located below the O-ring grooves and can be formed by machining away a portion of valve spindle 86, leaving pie-shaped valve segments 111 and 111*a*. As is best seen in FIG. 12, notch 110 can conveniently be formed in two straight passes of a milling tool which results in the creation of faces 111*b* and 111*c* of segment 111*a*. Notches 108 and 110 are substantially identical and in circumferential registry in the preferred embodiment.

Figure 14:
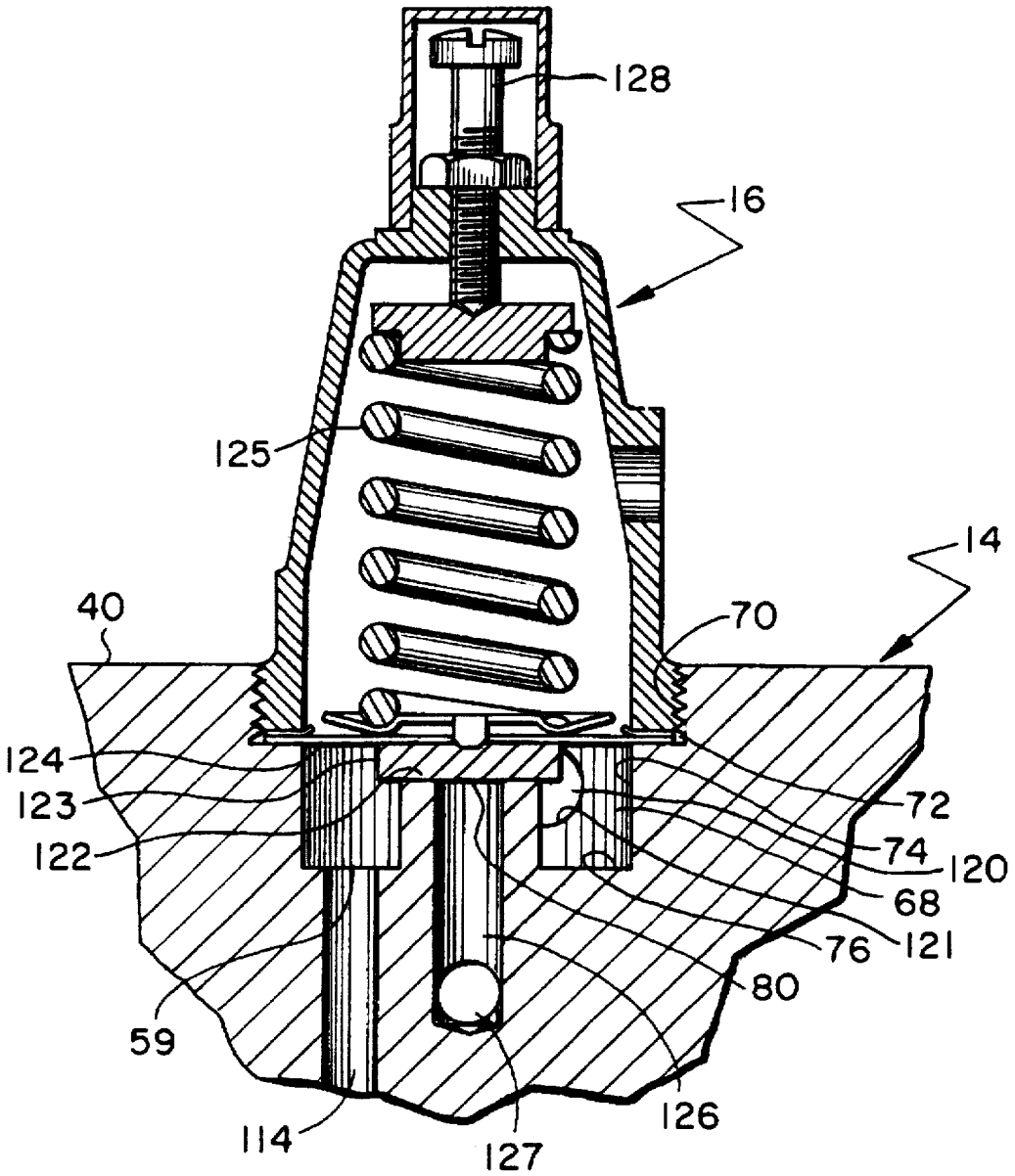
FIG. 14 is an isolated section view of an oil pressure regulator as installed on the housing of FIG. 3.

Referring primarily now to FIG. 14 and the structure of oil pressure regulator 16 as installed in recess 68 in side face 40 of housing 14, seat 122 of housing 14 engages a disk-shaped valve member 123 which is connected to a diaphragm 124 of oil pressure regulator 16. A valve spring 125 is disposed on the side of diaphragm 124 opposite valve member 123 in regulator 16 and applies a downward force which tends to keep the valve member 123 seated against the valve seat 122. The force with which valve spring 125 acts may be adjusted by means of a screw 128. A pressure relief passage 126 is defined within the regulator recess 68 and is isolated from recess 68 when valve member 123 is seated against valve seat 122. A bypass passage 127 which opens through port 93 into recess 97 and supply tank 20 communicates with relief passage 126 (see FIG. 16 in this regard).

Figure 16:
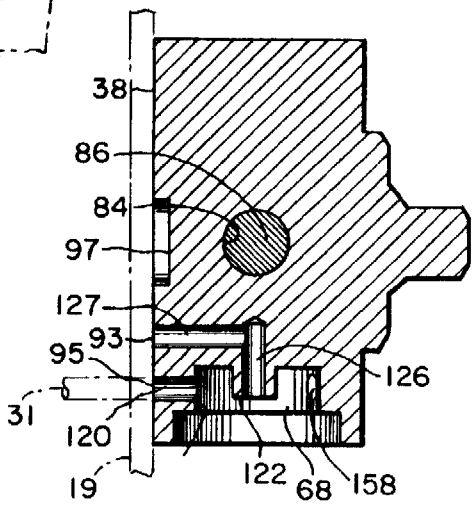
FIG. 16 is a section of the housing of FIG. 3 taken along lines 16—16 in FIG. 4.

Referring now to FIGS. 14, 15 and 16 and to the first step in the oil delivery process, oil is pumped from oil supply tank 20 through piping 31, to input port 95 in back face 38 of housing 14 and then into housing inlet passage 120. Passage 120 communicates with regulator recess 68 in the first side face 40 of housing 14. Oil pressure within recess 68 creates a force on regulator diaphragm 124 which opposes the force of spring 125.

If the resultant force from the oil pressure on diaphragm 124 exceeds the downward force of spring 125, valve member 123 is moved off of seat 122 which places regulator recess 68 and relief passage 126 in flow communication. This results in the diversion of some oil away from regulator output passage 114 and into relief passage 126 so as to maintain the desired oil pressure in regulator output passage 114. Oil diverted out of recess 68 and into passage 126 is delivered back into supply tank 20 after passing through bypass passage 127, port 93 and recess 97 in the back face 38 of housing 14.

As long as the force of the oil pumped from supply tank 20 (or driven from there such as by use of pressure) is less than the opposing force imposed by spring 125 on diaphragm 124, all oil entering recess 68 exits the recess through output channel 114. From passage 114 the oil, as will further be described, is directed to cavity 84 in which spindle 86 is disposed. The position of valve spindle 86 determines the location to which oil flowing out of channel 114 is delivered.

Figure 19:
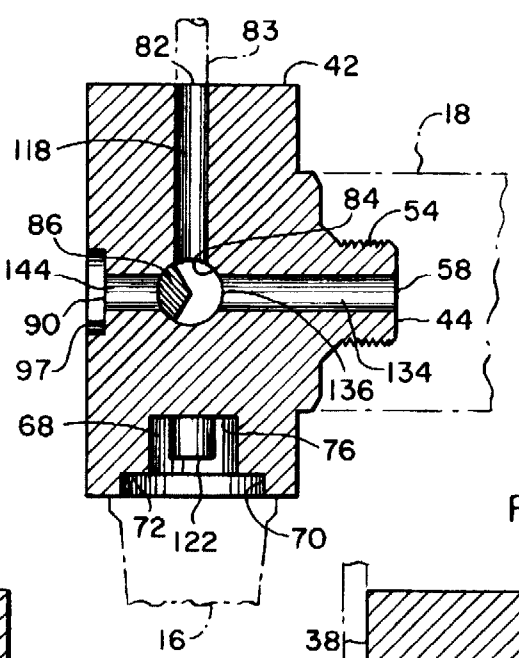
FIG. 19 is a section of the housing taken along lines 19—19 in FIG. 4.
Figure 18:
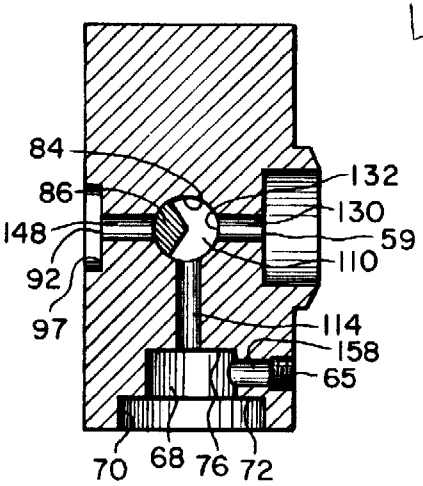
FIG. 18 is a section of the housing taken along lines 18—18 in FIG. 4.

Turning now to FIGS. 17, 18 and 19, the passage by which oil is delivered from pressure regulator 16 to oil filter 18 and the flow of oil through and out of oil filter 18 will be described. In that regard, oil filter input channel 130 has an internal port 132 which communicates with oil pressure regulator output passage 114 through cavity 84 and an external port 59 which opens into groove 50 of the oil filter receptacle.

Filter output channel 134 has an internal port 136 which opens into valve cavity 84 and external port 58 which is defined in surface 56 in the oil filter receptacle. Oil is delivered to output passage 134 after passing through a filtering element (not shown) disposed in filter 18. As will further be described, oil filter output channel 134 communicates, across notch 108 of spindle 86 in valve cavity 84, with oil feed channel 118 through which filtered oil is delivered out of port 82 in side face 42 to external line 83 under normal chiller operating conditions. Generally then, during normal chiller operation, oil is pumped from tank 20, to pressure regulator 16, through valve cavity 84, to oil filter 18 and then to the chiller lubrication points via line 83.

Referring now to additional features illustrated in FIG. 17, drain channel 138 has an internal port 142 which communicates with seepage void 113 in valve cavity 84 and an external port 94 which communicates with recess 97 in the back face of housing 14. Likewise, drain channels 144 and 148 have internal ports 146 and 150 which are in flow communication with valve cavity 84 and external ports 90 and 92 which communicate into recess 97. Drain channel 154 likewise communicates with valve cavity 84. The purpose of the drain channels is to ensure that any oil which accumulates or leaks in cavity 84 is drained and returned to storage tank 20.

Lubrication channel 152 communicates between valve chamber 84 and port 61 in front face 32 of housing 14 and provides a passage by which lubrication of the O-rings on spindle 86 is accomplished. O-rings 156, 156*a*, and 156*b* are seated within the grooves 106, 106*a* and 106*b* of spindle 86 to seal the space between spindle 86 and cavity 84. The O-rings prevent axial leakage of the pressurized chiller system lubricant upward along the spindle.

Referring now to the operational aspects of the present invention and the interaction of its parts, components and features, spindle 86, as has been noted, is rotatable about its longitudinal axis by the turning of head 87 into three positions, each of which sets up a different oil flow passage and each of which serves a different chiller lubrication related function. Spindle 86 may be locked in a desired position by engaging set screw or locking pin 64 with the appropriate recess in the valve spindle. A legend may be provided on the top face 34 of housing 14 and an indicator may be provided on the head 87 to indicate the function at each position.

Figure 20:
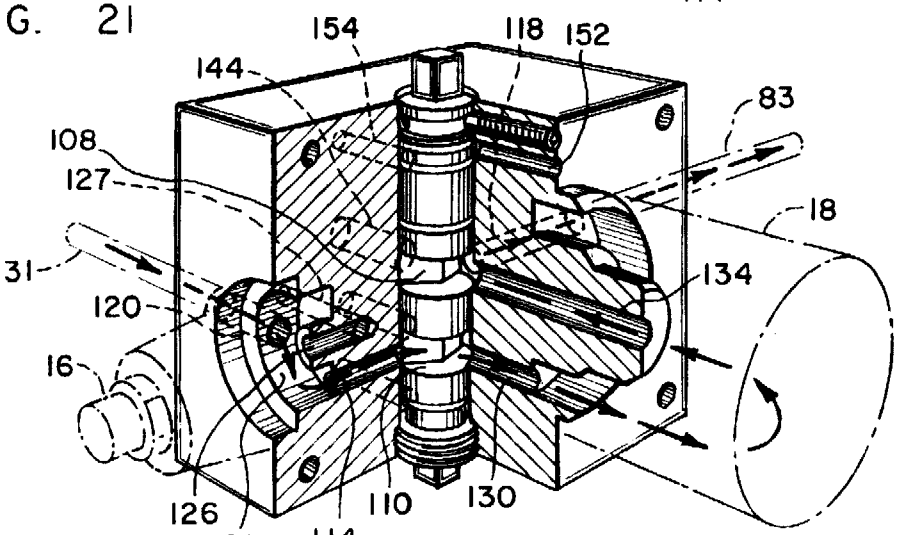
FIG. 20 is a cutaway perspective view of the oil management apparatus with the valve spindle positioned to run in its normal operating position and with an oil filter and oil pressure regulator shown in phantom.
Figure 23:
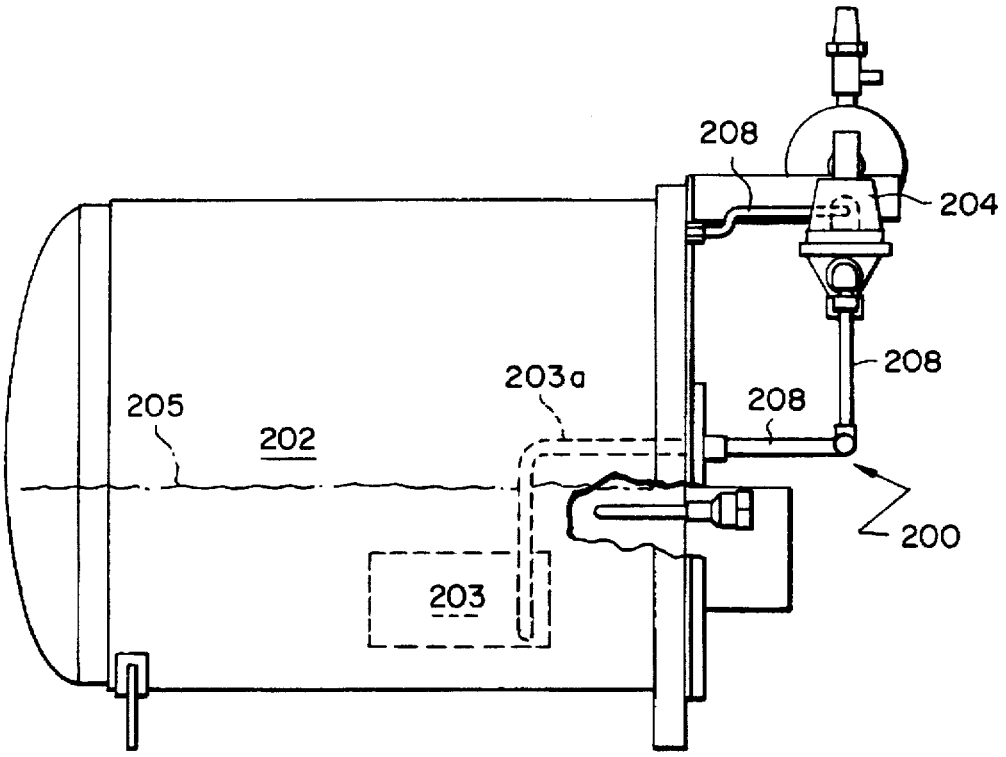
FIG. 23 (PRIOR ART)
FIG. 23 is a left side elevation of a prior chiller system.
Figure 24:
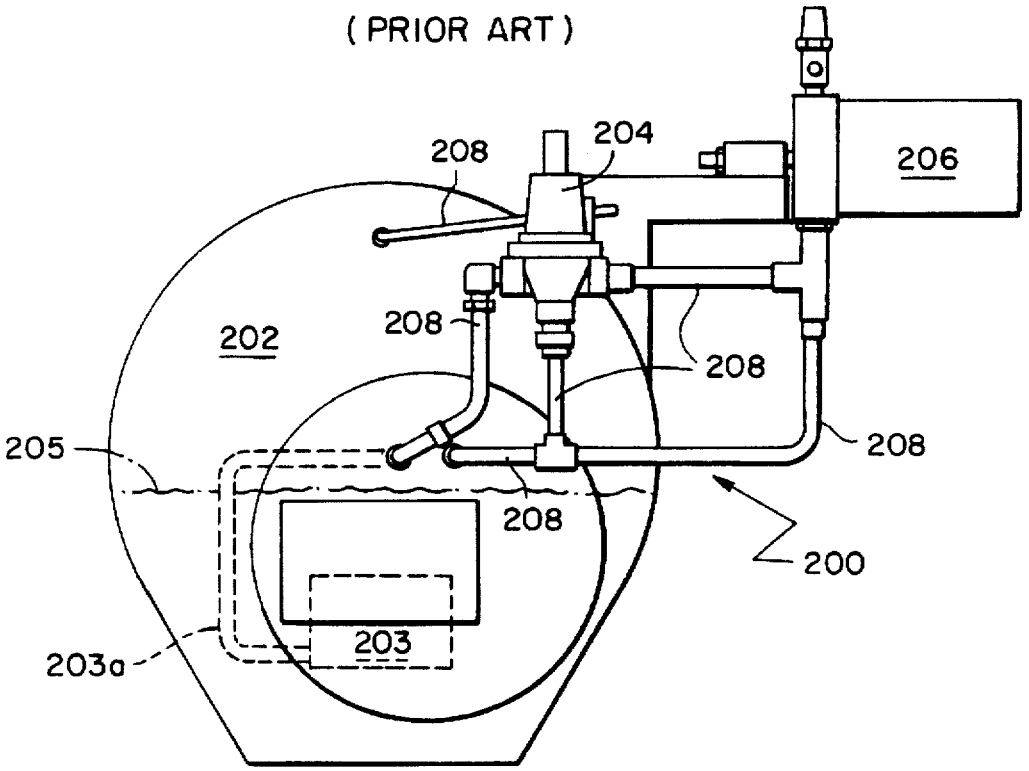
FIG. 24 (PRIOR ART)
FIG. 24 is a front elevation of a prior chiller system.

Following the flow of oil, which is best illustrated in FIG. 20, spindle 86 is placed in its first position when the chiller is in normal operation and requires lubrication. In this position, oil is pumped from supply tank 20 to inlet passage 120 in the back face of housing 14 and into regulator recess 68 through piping 31 which is located internal of tank 20.

If the pressure within the recess 68 exceeds a predetermined level, diaphragm 124 of the pressure regulator lifts, as explained earlier, so that a portion of the oil delivered to the regulator recess is diverted and returned to oil tank 20 through passages 126 and 127 in housing 14. The remaining portion of the oil flows out of regulator recess 68 into regulator output channel 114 at its predetermined and regulated pressure.

The oil then flows past notch 110 of spindle 86 in cavity 84 and into oil filter input passage 130. The oil next flows through a filter element (not separately shown) within filter 18 where impurities are trapped. Filtered oil then flows out of filter 18 through filter output channel 134, past notch 108 of spindle 86 and into oil feed channel 118 which supplies external feed line 83.

Line 83, in turn, delivers oil to lubrication points 12 in the chiller 10 as is indicated in FIGS. 1 and 2. It is to be noted that in the first position, oil sampling passage 158 (see FIG. 18) is placed in communication with oil pressure regulator recess 68 which allows the user to sample and check the system oil, prior to its being filtered, with the chiller operating if desired.

Figure 21:
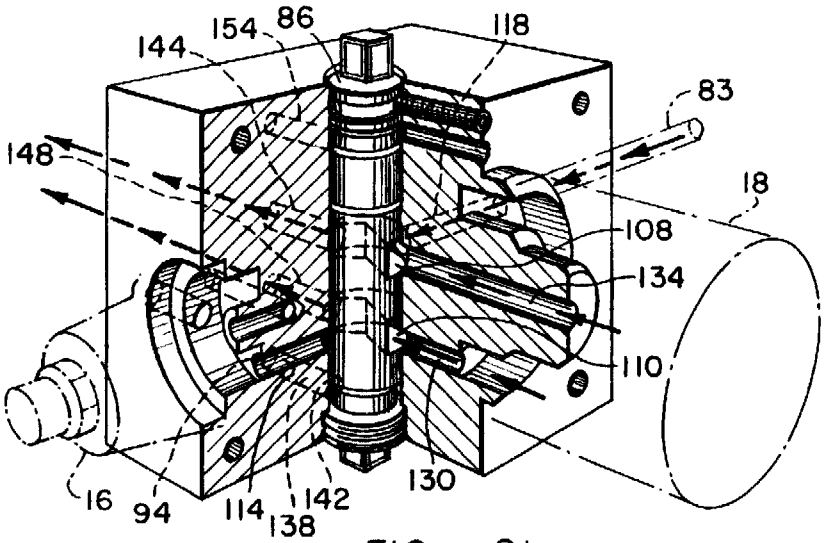
FIG. 21 is a view similar to FIG. 20, with the valve spindle positioned to drain oil from the chiller lubrication system.

Valve spindle 86 may be rotated ninety degrees to a second position as depicted in FIG. 21 in order to permit the chiller's lubrication system to be drained back to supply tank 20 for the changing of oil or during chiller maintenance and/or repair. When spindle 86 is in its second position, oil feed channel 118, through which oil is communicated out of housing 14 to external piping 83 and the chiller lubrication points, filter output channel 134 and drain channel 144 are all put in communication through notch 108 of valve spindle 86. Similarly, oil filter input channel 130 and drain channel 148 are placed in flow communication through spindle notch 110. Regulator output channel 114 is isolated by the body of the valve spindle.

In this position, oil drains back to tank 20 in a direction reverse to that in which it is normally flows through housing 14 to the chiller lubrication points. In that regard, oil flows from the lubricant points 12 on the chiller back 10 back through piping 83, through channel 118 and into channel 144 past notch 108. Similarly, oil from the filter 18 drains back through channel 134 into drain channel 144 past notch 108. Oil from exterior of the filter element (not shown) inside of oil filter 18 drains into passage 130, past notch 110, into drain channel 148 and back to oil tank 20. The oil pump in supply tank 20 is off when the chiller's lubrication system is being drained and oil drainage is by force of gravity since the chiller lubrication points are at a higher elevation than housing 14 and housing 14 is at a higher elevation than the level of oil internal of supply tank 20.

Figure 22:
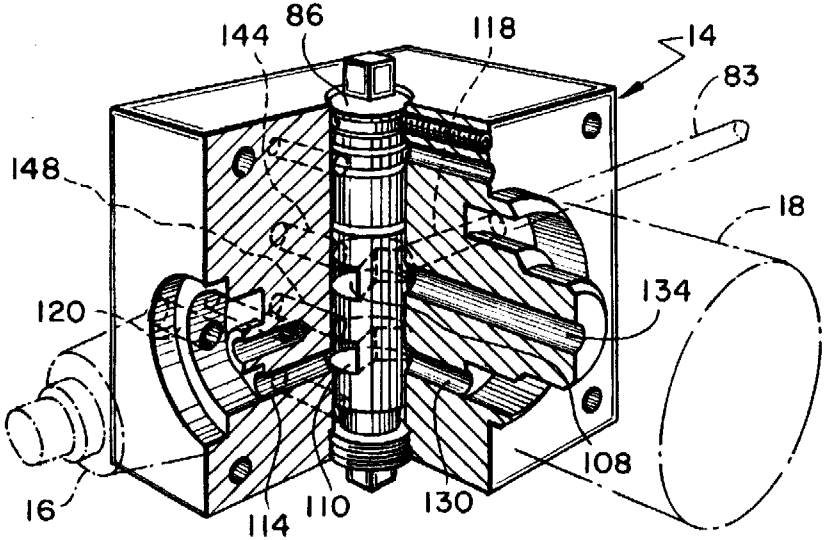
FIG. 22 is a view similar to FIG. 20 with the valve spindle positioned to isolate the oil filter for changing.

Referring now to FIG. 22, valve spindle 86 may be rotated a further ninety degrees to a third position. In the third position housing 14 is arranged in a manner appropriate to change oil filter 18. When spindle 86 is in its third position, oil feed channel 118 is placed in fluid communication with drain channel 144 through spindle notch 108 while regulator output channel 114 is placed in communication with drain channel 148 through the notch 110. Oil filter input and output channels 130 and 134 are isolated from cavity 84 by the body of valve spindle 86 in this position.

Chiller 10 and oil pump 29 will be de-energized when the oil filter is changed. Alternatively, if chiller 10 is employed in an application where de-energizing the chiller it is not possible, a second housing 14 (not shown) can be piped into line 83 and valving can be provided to isolate the housings from each other so that one of them may be kept "on line" at all times, even while the oil filter of one of them is changed. In the more normal instance, where the chiller application permits the chiller to be de-energized for periods of time such as to permit the change of an oil filter, a single housing 14 will be employed and the oil pump and chiller will, once again, be de-energized in order to change the oil filter.

It is to be noted that if the oil filter receptacle were not isolated during filter change the removal of filter 18 from housing 14 to permit its change would open the refrigerant side of the chiller to ambient through the lubrication lines. Also, removal of the filter without isolation of its receptacle in housing 14 would cause oil to drain out of the chiller from its lubrication points through the receptacle. The positioning of valve spindle 86 to its third position ensures that no such flow passage out of the chiller to the atmosphere surrounding the chiller is created, whether for oil or system refrigerant, as a result of the oil filter change process. Therefore, the purpose of positioning valve spindle 86 to position three is two-fold, the first purpose being to permit the change of oil filter 18 and the second being to isolate the oil and refrigerant charge contained within the chiller from the surrounding atmosphere.

It will be appreciated that housing 14 eliminates the need to connect various components of a chiller oil delivery system by means of a large number of custom fabricated, relatively delicate and difficult to assemble individual oil lines. The chiller oil management apparatus of the present invention is compact, durable, less susceptible to damage, less labor intensive to fabricate and assemble and therefore, less expensive to manufacture than previous management apparatus. It will also be appreciated that by providing a single valve spindle 86, which is positionable to only three positions to coordinate the chiller oil flow, the likelihood of operator error in the proper setup of a lubrication system for a particular operational or maintenance mode is tremendously reduced as is system downtime due to damage resulting from such error.

We claim:

1. Oil management apparatus in a refrigeration chiller comprising:

an oil supply tank;

means for pumping oil from said supply tank;

oil conduit means in flow communication with at least one chiller location which requires the flow of oil thereto during the operation of said chiller; and a housing in fluid communication with said supply tank, said housing defining a valve cavity having a valve spindle disposed therein, said valve spindle being positionable to (i) a first position so as to open an oil flow path through said housing from said supply tank to said conduit means, (ii) a second position so as to open a flow path to permit the draining of oil through said housing from said conduit means back to said supply tank and (iii) a third position so as to interrupt and isolate, within said housing, a portion of said oil flow path from said supply tank to said conduit means.

2. The oil management apparatus according to claim 1 further comprising an oil pressure regulator and an oil filter, both said oil pressure regulator and said oil filter defining a portion of said oil flow path from said supply tank to said conduit means.

3. The oil management apparatus according to claim 2 wherein said housing further defines a normally closed relief path between said oil pressure regulator and said supply tank, said relief path opening when the pressure of oil flowing from said supply tank to said housing and through said oil pressure regulator exceeds a predetermined pressure.

4. The oil management apparatus according to claim 3 wherein said housing defines an oil filter receptacle, said oil filter being ensconced in said oil filter receptacle, the portion of said oil flow path defined by said oil filter being in said portion of said oil flow path which is isolated when said spindle is in said third position.

5. The oil management apparatus according to claim 4 wherein said housing defines an oil pressure regulator receptacle, said oil pressure regulator being ensconced in said oil pressure regulator receptacle.

6. The oil management apparatus according to claim 5 wherein oil flowing from said supply tank to said oil conduit means and oil draining from said conduit means back to said supply tank flows through said valve cavity in a direction which is perpendicular to the axis of said cavity.

7. The oil management apparatus according to claim 6 wherein said housing is mounted to an exterior wall of said oil supply tank at an elevation above the level of oil therein.

8. The oil management apparatus according to claim 2 wherein said housing defines a first flow passage communicating between said supply tank and said oil pressure regulator, a second flow passage communicating between said oil pressure regulator and said valve cavity, a third flow passage communicating between said valve cavity and said oil filter, a fourth flow passage communicating between said oil filter and said valve cavity, a fifth oil flow passage communicating between said valve cavity and said oil conduit means, a sixth flow passage communicating between said valve cavity and said supply tank, a seventh flow passage communicating between said oil pressure regulator and said supply tank and wherein said valve spindle defines first and second notch portions, oil flowing sequentially from said supply tank, through said first flow passage, through said oil pressure regulator, through said second flow passage, through said first spindle notch, through said third flow passage, through said oil filter, through said fourth flow passage, through said second spindle notch and through said fifth flow passage when said valve spindle is in said first position, oil being diverted and flowing from said oil pressure regulator back to said supply tank through said seventh flow passage when the pressure of oil delivered to said oil pressure regulator from said supply tank through said first flow passage exceeds a predetermined pressure.

9. The oil management apparatus according to claim 8 wherein said housing defines an eighth flow passage and wherein oil drains back to said supply tank (i) from said oil filter through said third flow passage, across said first spindle notch and through said sixth flow passage and (ii) from said oil filter through said fourth flow passage, across said second spindle notch and through said eighth flow passage and (iii) from said conduit means through said fifth flow passage, across said second spindle notch and through said sixth flow passage, all when said valve spindle is in said second position.

10. The oil management apparatus according to claim 9 wherein said third and fourth flow passages are isolated from said valve cavity by said valve spindle when said valve spindle is in said third position.

11. The oil management apparatus according to claim 9 further comprising means for draining said valve cavity back to said supply tank other than through said sixth and said eighth flow passages.

12. The oil management apparatus according to claim 9 wherein said housing further defines an oil sampling passage, said oil sampling passage being controllably in flow communication between the exterior of said housing and said oil pressure regulator receptacle.

13. The oil management apparatus according to claim 9 wherein said housing defines a recess, said sixth and said eighth flow passages and said means for draining said valve cavity opening into said recess, said recess being in flow communication with said supply tank so that oil flowing through all of said means for draining, said sixth flow passage and said eighth flow passages flows first into said recess prior to draining to said supply tank.

14. An assembly for managing oil flow between an oil supply tank and lubrication points in a refrigeration chiller, said assembly comprising:

a housing, said housing having an integral filter receptacle, an oil filter disposed in said filter receptacle, an integral regulator receptacle, an oil pressure regulator disposed in said regulator receptacle, a valve cavity, a plurality of internal ports communicating with said valve cavity, first and second external ports communicating with said filter receptacle, said first and second external ports respectively communicating with a first and a second of said internal ports, a third external port in communication with said regulator receptacle, said third external port being a port through which oil is supplied to said housing, a fourth external port communicating with said regulator receptacle and with a third one of said internal ports, and an external oil feed port in flow communication with the lubrication points in the chiller and with a fourth one of said internal ports; and a valve spindle rotatably received within said valve chamber for selectively opening and closing said internal ports.

15. An assembly according to claim 14 further comprising means for delivering oil from said supply tank to said housing.

16. An assembly according to claim 14 wherein said valve spindle permits the flow of oil through said first external port of said filter receptacle in a first direction when said valve spindle is rotated to a first position and enables oil drainage in a reverse direction through said first external port when rotated to a second position.

17. An assembly according to claim 14 wherein said valve spindle isolates said filter receptacle from said valve cavity when rotated to a third position.

18. An assembly according to claim 14 wherein said valve spindle is generally cylindrical and defines first and second notched portions across and through both of which oil flows when said spindle is in said first position.

19. An assembly according to claim 14 wherein said housing defines an oil sampling passage communicating between said regulator receptacle and a fifth external port.

20. An assembly according to claim 14 wherein said housing defines a normally closed relief passage communicating between said regulator receptacle and said supply tank and wherein said housing is mounted on said oil supply tank at an elevation higher than the level of oil in said tank.

21. A method of controlling the flow of oil to lubrication points in a refrigeration chiller comprising the steps of:

defining a plurality of flow passages and a valve cavity in an integral housing;

disposing a valve spindle in said valve cavity, said valve spindle defining a plurality of notches;

disposing an oil pressure regulator on said housing;

disposing an oil filter on said housing;

flowing oil internal of said housing to said oil pressure regulator through said housing;

flowing oil internal of said housing from said oil pressure regulator to said oil filter through said cavity across a first of said spindle notches; and flowing oil internal of said housing from said oil filter through said cavity, across a second of said spindle notches and then out of said housing, said flowing steps operating to provide filtered oil at a predetermined pressure to said chiller lubrication points when said chiller is in normal operations.

22. The method according to claim 21 comprising the further step of diverting a portion of the oil flowed to said pressure regulator through and out of said housing when the pressure of said oil exceeds a predetermined pressure.

23. The method according to claim 22 comprising the further step of re-positioning said spindle in said cavity in order to isolate and change said oil filter.

24. The method according to claim 23 comprising the further step of re-positioning said spindle so as to permit the draining of oil out of said chiller and out of said oil filter by flowing oil from said chiller and from said oil filter into said housing, across said first and said second spindle notches and then out of said housing.

* * * * *